United States Patent [19]

Seragnoli

[11] 3,953,021

[45] Apr. 27, 1976

[54] APPARATUS FOR ACCUMULATING AND SUPPLYING SHEETS

[75] Inventor: Enzo Seragnoli, Bologna, Italy

[73] Assignee: G. D Societa per Azioni, Bologna, Italy

[22] Filed: May 23, 1975

[21] Appl. No.: 580,302

Related U.S. Application Data

[63] Continuation of Ser. No. 476,305, June 4, 1974, abandoned.

[30] Foreign Application Priority Data

July 31, 1973 Italy ..... 3455/73

[52] U.S. Cl. ..... 271/3.1; 198/37; 214/8.5 A

[51] Int. Cl.[2] ..... B65H 1/30

[58] Field of Search..... 271/3.1, 3, 213, 217–219; 221/104, 105; 198/26, 29, 37; 214/8.5 A, 307, 622, 741; 53/59 R

[56] References Cited

UNITED STATES PATENTS

| | | | |
|---|---|---|---|
| 3,591,018 | 7/1971 | Nalbach | 271/3.1 |
| 3,655,072 | 4/1972 | Bateman | 214/8.5 A |
| 3,776,544 | 12/1973 | Watson et al. | 271/3.1 |

*Primary Examiner*—Evon C. Blunk
*Assistant Examiner*—Robert Saifer
*Attorney, Agent, or Firm*—Robert E. Burns; Emmanuel J. Lobato; Bruce L. Adams

[57] ABSTRACT

An apparatus for accumulating and supplying sheets comprises a container in the form of a well, from the base of which the sheets are removed individually in rhythmic succession. An intermittently movable support device is in vertical alignment above the container. A conveyor device conveys in an inching fashion towards the support device, a plurality of piles of sheets side by side. Centering and transfer means handle whichever pile of sheets is, at any particular movement, closest to the support device. Means are provided for operating, with an inching movement, the support and conveyor devices for operating the centering and transfer means, enabling the individual piles to be transferred in succession from the conveyor device to the support device and from the latter to the inside of the fixed container, once a predetermined level is reached inside the container.

5 Claims, 3 Drawing Figures

APPARATUS FOR ACCUMULATING AND SUPPLYING SHEETS

This is a continuation, of application Ser. No. 476,305, filed June 4, 1974 and now abandoned.

BACKGROUND OF THE INVENTION

This invention relates to cigarette packeting machines of the hinge lid type and, to be more precise, has as its subject an apparatus for accumulating and supplying lengths of material in sheet form, particularly cuttings or packet blanks and similar, fitted to the packeting machines.

DESCRIPTION OF THE PRIOR ART

With cigarette packeting machines of the afore mentioned type the usual practice is to stack a column of cuttings in a hopper-type container, inside which they drop downwards by gravity and from the base of which they are removed individually in order to be subsequently supplied to the wrapping mechanism of the machine.

The recharging operation is carried out by manually topping up the stack with fresh piles of cuttings inserted through the top of the container, as they become depleted.

The systems for removing the cuttings from the container necessitate the pressure exerted by the pile on its lower level being kept within certain limits, in such a way that the extraction of the cuttings from the base of the snack, customarily performed by suction means, is not hampered.

For these reasons of a mechanical nature and for practical reasons connected with the manual recharging operation, the height of the container in which the cuttings are housed has to be limited.

On account of the foregoing, the potential of the devices for accumulating and supplying cuttings to a packeting machine is seriously restricted and thus it is necessary for the operator to frequently recharge the container.

High speed packeting machines are particularly prone to these difficulties and consequently the problem of recharging the storage unit containing the cuttings presents an aspect of special practical and financial interest.

In order to overcome the foregoing, use has been made of a storage unit or magazine inclined at an angle with respect to the vertical, provided with a lateral wall which is movable so that it can be adjusted at a different angle towards the inside of the container.

This tended to increase the capacity of the container as well as to also alleviate the pressure of the pile on the cuttings at low level and, by regulating the angular adjustment of the movable wall, to facilitate separating the individual cuttings from the base of the pile in rhythmic succession.

SUMMARY OF THE INVENTION

The Applicants have, instead, thought of remedying matters by making available an apparatus, wherein a vertical pile of cuttings is kept at an almost constant level in such a way that the suction means can be guaranteed unfailingly and efficiently removing the individual cuttings, in a rhythmic fashion, from the base of the vertical pile at a speed synchronized with that at which high output speed packeting machines can run when going all out.

The subject of the present invention is, in fact, an apparatus for acccumulating and supplying lengths of material in sheet form, particularly cuttings or packet blanks and similar, to cigarette packeting machines of the hinge lid type which operate in conjunction with a fixed container or vertical cavity in the form of a well, from the base of which the sheets or cuttings are removed individually so that they can be supplied, via a conveyor, to the wrapping mechanism of the packeting machine in rhythmic succession, essential features of the said apparatus being that it comprises: an intermittently movable support device placed in vertical alignment above the said fixed container; a conveyor device for sustaining and conveying in an inching fashion towards the support device a plurality of piles of cuttings, side by side; centering/transfer means for handling whichever pile of cuttings is, at any particular moment, closest to the support device so as to first arrange the pile in one direction, lining it up with respect to the fixed container and then, in the direction at a right angle to the former, transferring it on to the support device; means for operating with an inching movement, the support and conveyor devices, as well as for operating the centering/transfer means; and feeler means sensitive to the level of the pile of cuttings in the inside of the fixed container, for tripping the means for operating with an inching movement, the support device and the conveyor device and for actuating the centering/transfer means so as to allow the individual piles to be transferred in succession from the conveyor device to the support device and from the latter to the inside of the fixed container once a predetermined level has been reached in the inside of the fixed container.

BRIEF DESCRIPTION OF THE DRAWINGS

Further characteristics and advantages will emerge more clearly from the following detailed description of a preferred but not the sole form of embodiment for the apparatus according to the invention, illustrated purely as a non-limiting example on the accompanying drawings in which.

DESCRIPTION OF THE PREFERRED EMBODIMENT

Figure 1:
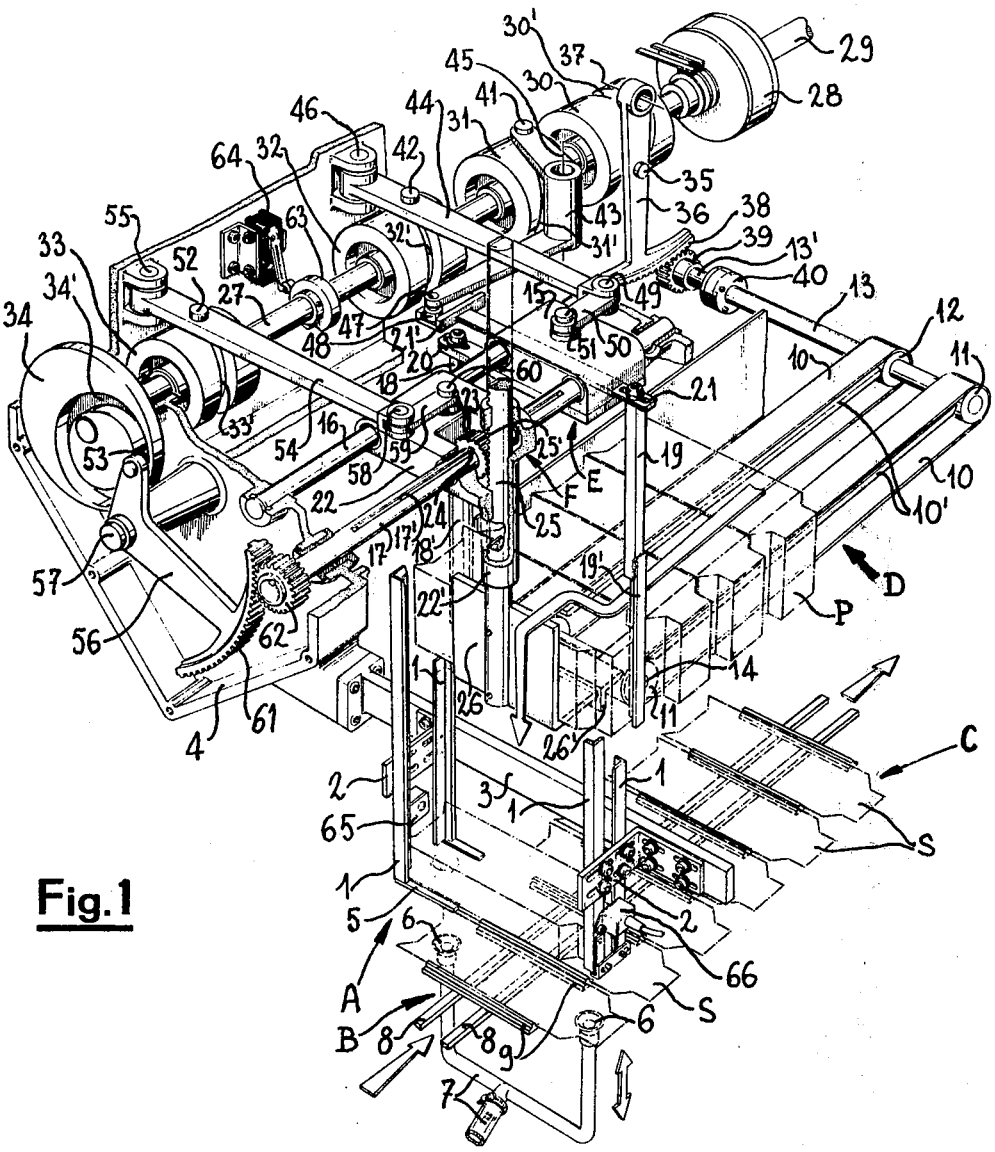
FIG. 1 shows, in a perspective view, the apparatus in question with certain parts in sectional form or removed so that others can be better seen.

A chute or hopper or fixed container A has packeting cuttings S individually removed therefrom in succession by a device B for removing the cuttings S by suction onto a continuous conveyor belt C for carrying the cuttings S to the packeting machine, not shown.

The letters D, E and F, respectively, refer to the basic parts or assemblies belonging to the apparatus forming the subject of the present invention, that is to say, to the conveyor D for sustaining and conveying in an inching fashion, as will be seen more readily in due course, the piles P of cuttings S, shown with dots and dashes, which have to be gradually transferred individually into the inside of the chute A; the device E with combined reciprocatingly movable centering/transfer means for centering and transferring the individual piles P of cuttings S with respect to and in vertical alignment with the chute A; and the support device, F also movable in combined successive steps, for receiving the individual piles P of cuttings S from the device E provided with the centering/transfer means, and for feeding them into the inside, towards the bottom of the A in a way which will be described later on in the description of the operation of the complete unit depicted.

The chute or hopper or fixed container A is of the type that can be regulated capacity-wise in the two right angle directions and it consists of four stanchions 1 formed by angle bars interconnected in pairs in an adjustable fashion by connecting plates 2, which are fastened, also in an adjustable way, to a bar 3 fixed to the frame 4 of the new apparatus.

At the base of the chute, strips 5 are provided and these project inwards for a short distance in order to act as support teeth for the pile of packeting cuttings S.

The device B for removing the cuttings S from the base of the chute A by means of suction essentially consists of a plurality of suction pads 6 mounted for a vertical reciprocating movement and connected to a source of suction (not depicted on the figure) through the pipes 7.

The continuous conveyor belt C is of the type with pockets for holding the individual cuttings S and it essentially consists of a plurality of belts 8 wound in closed ring fashion around pulleys (not illustrated). The belts 8 are transversely interconnected by means of T section bars 9 positioned upside down in such a way that pockets in which the individual cuttings S fit are formed, each by two successive bars 9.

The conveyor D for sustaining and conveying in an inching fashion the piles P of cuttings S towards the device E provided with centering/transfer means and towards the device F for supporting and feeding the said piles P of cuttings S into the inside of the chute A, extends parallel with the aformentioned conveyor belt C, in vertical alignment above it, up as far as the vicinity of the upper extremity of the chute A and at practically its same level.

The conveyor D consists of a plurality of belts 10 wound in closed ring fashion around respective pairs of pulleys 11 and 12 mounted on the shafts 13 and 14 which are supported in a known way by the aforementioned frame 4 of the apparatus in question, with the shaft 13 being driven in the manner described hereinafter to operate conveyor D in an inching fashion. The upper part of the belts 10 on which the piles p of cuttings S rest slides on support plates 10' carried in any conventional way by the frame 4.

The device E provided with the centering/transfer means is composed of a block 15 slidingly mounted so that, as will be seen in due course, it can be made to move in the form of a carriage along shafts 16 and 17, parallel to conveyor D, one of which is fixedly supported and the other rotatably supported, as will be seen later on, by the frame 4. Carriage block 15 has two vertical rods 18 and 19, the lower sections 18' and 19' of which are of transverse bracket conformation. The upper extremity of the rod 18 is connected in an adjustable fashion to a lateral lug on the aforementioned sliding block 15, while the upper extremity of the rod 19 is connected, also in an adjustable manner, to one end of a strip 21 carried by the block 15 slidingly in a direction perpendicular to that in which the block 15 itself slides on the shafts 16 and 17.

The other extremity of the strip 21 has a part 21' extending parallel with the shafts 16 and 17, shaped as a cross section in the form of a U and this engages with the unit operating it which, will be described hereinafter.

The device F for supporting and feeding the piles P of cuttings S to the inside of the chute A is composed of a block 22 slidingly mounted so that it can be made to move in the form of a carriage along the shafts 16 and 17. The block 22 houses inside it a gear 23 mounted on the shaft 17 rotatably with it but slidingly with respect to it by means of a key 24 which slides in the slot 17' running longitudinally in the shaft 17. The block 22 comprises vertical tube 22' and this slidingly engages with a vertical rod 25, the upper section of which is in the form of a rack 25' which meshes with the gear 23. The bottom end of the vertical rod 25 carries a bracket shaped member 26 fashioned like a chair turned towards the conveyor. As shown in FIG. 1 a member 26' carried by the frame 4 is placed between the conveyor D and the chair shaped member 26 so as to render the horizontal plane between the said conveyor D and the said chair shaped member 26 continuous.

The shaft 13 which operates in an inching fashion the conveyor D, and the blocks 15 and 22 with strip 21 take their drive, as does the shaft 17 for operating the devices E and F, from a main power shaft 27 rotatably carried by the frame 4 of the apparatus.

The shaft 27 which constitutes the cyclic drive shaft for the new apparatus can either be moved in an independent fashion using conventional means not shown on the drawing, or else it can take its drive, through a magnetic clutch 28 of any known type, from the shaft 29 of the packeting machine, with the operation being based on a predetermined reduction ratio which obviously suits both the production speed or rate of absorption of the cuttings S by the packeting machine and the average height of the piles P of cuttings S to be fed to the chute A.

Thus, for example, if the absorption speed of the packeting machine is 400 cuttings per minute, which corresponds to a production speed of 400 packets per minute, and the height of the individual piles P is the equivalent of 200 of the said cuttings S, it is obvious that the cyclic drive shaft 27 of the new apparatus must, in the course of one minute, effect two revolutions or turns corresponding to two operating cycles of the apparatus, the ratio, therefore, being 200:1.

It is also obvious that the limits inside which the operating cycle of the infeed apparatus can be effected with respect to the individual successive production cycles of the packeting machine depends on the number or height of the pile of cuttings S in reserve inside the chute A that it is wished to maintain from the beginning to the end of the cycle corresponding to the infeed or discharge operation of the piles P into the inside of the chute A. Again, as a further example, if, as stated above, the rate of absorption of the packeting machine is 7 cuttings S per second (a little over 400 per minute) and the height of the pile in reserve in the inside of chute A that it is wished to maintain corresponds to 50 cuttings S, it is apparent that the above mentioned difference in timing must not substantially exceed 7 seconds.

For practical reasons, however, it has been seen that it is advisable for the difference in timing mentioned above be kept to a rock bottom in order to prevent the rate at which the piles are discharged from being too high compared with that at which they are positioned below, which would adversely affect the hold the support teeth 5 underneath the hopper A have on the cuttings.

Five cams 30, 31, 32, 33 and 34, are, therefore, keyed on to the aformentioned cyclic drive shaft 27, the first four of these being cylindrical type cams and the fifth, a disk cam.

A cam follower loosely carried by a pin 35 fixed at an intermediate point along a lever 36 which pivotally oscillates at one end around a spindle 37 fixedly carried by the frame 4 of the apparatus, engages with the race 30' of the cam 30. The other extremity of lever 36, shaped as a gear segment 38, meshes with a gear 39 keyed on to a shaft 13' connected to the shaft 13 by means of a one-way clutch or free wheel device 40 of any known type.

In this way, as will be seen later on, the conveyor D is ensured of its drive.

Cam followers fit into the races 31' and 32' of the cams 31 and 32, respectively, and these are carried loosely by the pins 41 and 42, respectively, the pin 41 being fastened to the free end of one arm of a two armed lever 43 and the pin 42 being secured at an intermediate point of a lever 44. The levers 43 and 44 are mounted so that they oscillate around their spindles 45 and 46, respectively, which are fixedly carried by the frame 4 of the apparatus. The free extremity of the other arm of the two armed lever 43 carries, by means of a pin 47, another idle roller 48 which engages with the slot in the U shaped part 21' of the strip 21 sliding on the bolck 15, while the free end of the lever 44 is articulated at 49 to one end of a link rod 50, the other end of which is articulated at 51 to the aformentioned block 15.

In this way the strip 21 and the block 15 of the device E provided with centering/transfer means are ensured of their drive.

The device F for supporting and feeding the piles P of cuttings S into the inside of the chute A is, in turn, ensured of its drive through the cams 33 and 34, the races of which 33' and 34', respectively, engage with the cam followers loosely carried by the pins 52 and 53, respectively. The pin 52 is fastened at an intermediate point in a lever 54, one end of which is pivoted so that it oscillates around a spindle 55 fixedly carried by the frame 4, while the pine 53 is secured to the free end of one of the arms of a two armed lever 56 which is pivoted so that it oscillates around a spindle or pin 57 also fixedly carried by frame 4. The other extremity of lever 54 is articulated at 58 to one end of a link rod 59 and the other end of this is articulated at 60 to the block 22, while the free end of the other arm of the two armed lever 56, shaped as a gear segment 61, meshes with a gear 62 rigidly mounted on the rotatable shaft 17.

The cyclic drive shaft 27 also has keyed on to it a cam 63 destined to trip the operating mechanism of a microswitch 64 for a purpose which will be seen from the description of the way in which the apparatus operates given hereinafter.

Thus, with the structure described above and with the aid of a feeler assembly or detector device or photoelectric cell of a known type connected to the hopper A, the apparatus carries out in practice exactly what was intended, as will be seen from the description of the operation of the said apparatus.

Figure 3:
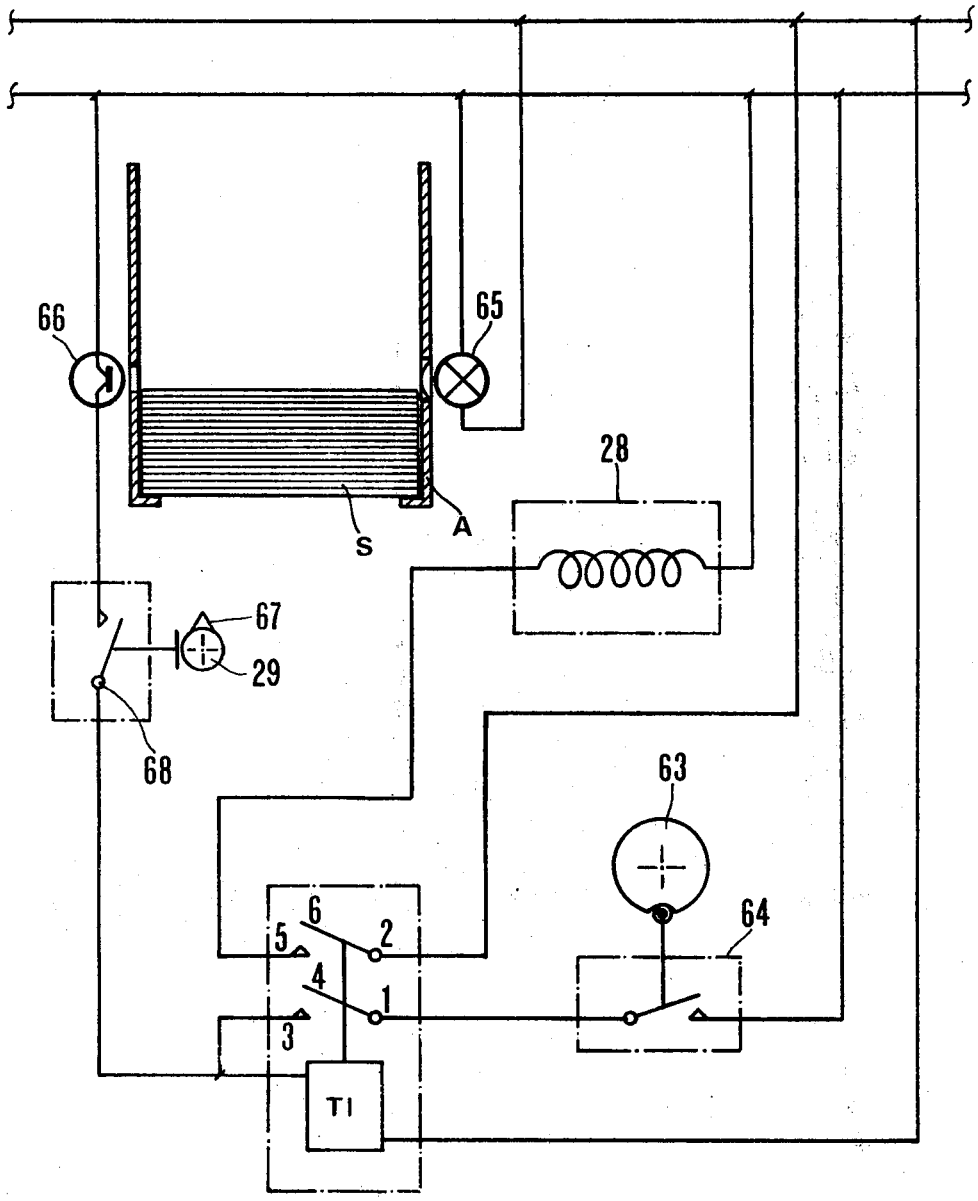
FIG. 3 shows the electrical operating circuit diagram for the apparatus in question.

The photoelectric cell device, see also FIG. 3, consists, as is known, of a lamp 65 with a device for projecting a beam of light towards a phototransistor 66 positioned in such a way as to be hit by the beam of light, at a suitable level, through the inside of the chute.

Besides the photoelectric cell detector device, the aforementioned FIG. 3 also schematically depicts the chute A, the magnetic clutch 28, the contact of the micro-switch 64 with its tripping cam 63, a synchronizing cam 67 (fitted to the cyclic shaft 29 of the packeting machine), an associated electric contact 68 and a contactor T1 in series with this contact. The contactor T1 has two normally open contacts, movable from open positions T11-4 and T12-6, respectively, to the closed position T11-3 and T12-5, respectively, the first of the two contacts being used to make the contactor self-exciting.

Figure 2:
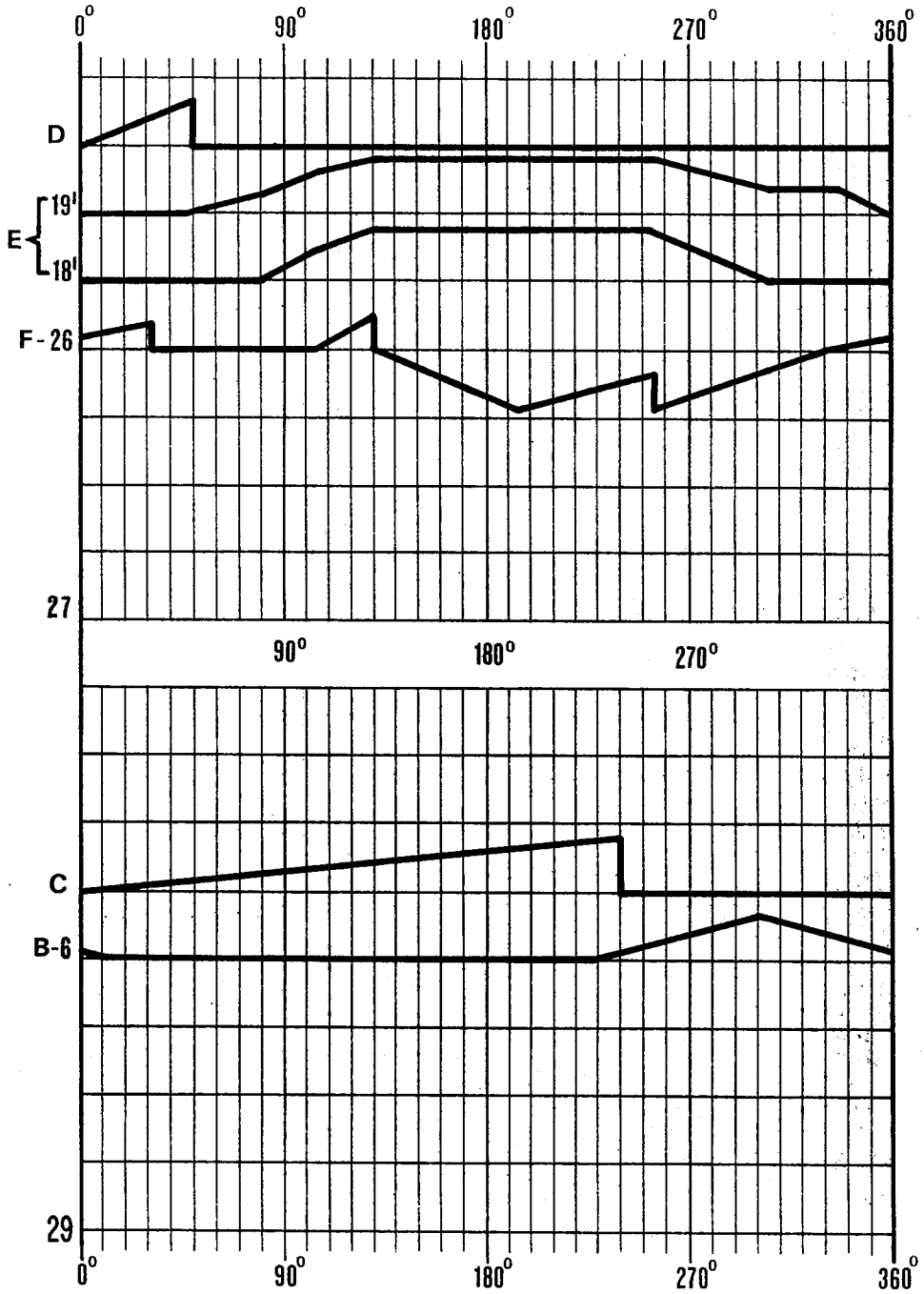
FIG. 2 shows the time-phase graphs, based on one operating cycle, for the basic mechanism of the apparatus forming the subject of the invention, as well as for the devices belonging to the packeting machine to which the apparatus is directly coupled.

Assuming (1) that, as stated in the example given earlier on, the ratio (see FIG. 2) between the cyclic shaft 29 of the packeting machine and the cyclic shaft 27 of the new apparatus is 200:1, (2) that the conveyor C and the suction pads 6 of the device B for removing the cuttings S by suction from the bottom of chute A perform their successive intermittent to-and-fro movements corresponding to 240° of movement and 120° of immobility and to 220° of immobility and 140° of to-and-fro movement, respectively, for each rotation of the cyclic shaft 29, and that at the moment of a cycle being initiated, as can be seen from the relevant graphs on FIG. 2, both the exit infeed conveyor C and the conveyor D are at a standstill and about to commence their successive inching movements from the 0° position of the cyclic shafts 29 and 17, respectively, the operation of the new apparatus takes place in the following way:

The cyclic rotation of the shaft 29, carries in rotation the synchronizing cam 67, thus cyclically closing the electric contact 68. As long as the pile of cuttings S in reserve in the inside of the chute A is at a higher level than that of the beam of light from the detector device 65–66, which in this way is broken, the electric contact 68 continues to stay open but as the cycles follow on one after the other, the level of the reserve pile gradually sinks until the beam of light is uncovered and hits the phototransistor 66 which, since it becomes conductive causes closing of contact 68, energizing the contactor T1 (see FIG. 3).

The excitation of contactor T1 causes its pair of moving contacts to close and thus to go from the open position T11-4 and T12-6 to the closed position T11-3 and T12-5, respectively. The closing of the contact T12-5 causes the magnetic clutch 28 to operate, thereby bringing about the rotation of the cyclic shaft 27 which as it rotates, causes, through the cam 63, the contact of the micro-switch 64 to close and the consequential closing of the self-excitation circuit of the contactor T1 through its self-exciting contact being carried into the T11-3 closed position, as previously seen, following the excitation of the said contactor T1.

The rotation of the cyclic shaft 27 results in rotation of the operating cams 30, 31, 32, 33 and 34 keyed to it, which, by means of the profiles 30', 31', 32', 33' and 34', respectively, determine the movements of the conveyor D, of the device E provided with centering/transfer means and of the chair shaped member 26 in accordance with the sequences shown by way of examples in the graphs in FIG. 2.

The profile 30' of the cam 30 is, in particular, such that it causes the lever 36 to move in an oscillating fashion and, through its sector gear 38 which meshes with the gear 39, to bring about the rotation of the shaft 13'-13 and consequently when the shaft 27 undergoes a 50° rotation (see FIG. 2) the belts 10 of the conveyor D move thus causing the piles P of cuttings S to move one step forward towards the chair shaped member 26 of the device F between the rods 18' and 19' of the device E.

In the remaining 310° of rotation of the cam 30, the lever 36 returns to its original position and thanks to the free wheel device 40, no other movement is given to the shaft 13'-13.

The rotation of the cam 31 causes, instead, with its profile 31' the two-armed lever 43 to oscillate and, as a consequence of the connection that exists with the strip 21, the rod 19, 19' to traverse about 35° of the cycle with respect to the infeed direction of the conveyor D of the rod 19, 19', whereby the bracket shaped section 19' of the rod 19 carries the pile P of cutting S initially at a standstill in between the two arms 18-18' and 19-19' in a movement up against the part of the arm with a bracket configuration 18'. The cuttings in the corresponding pile are rearranged (a) in the direction of this movement and in alignment (b) in the direction perpendicular to that of this movement.

The profile 32' of the cam 32 passes an oscillating movement on to the lever 44 and this causes the block 15 to slide along the shafts 16 and 17 and, consequently, the rods 18-18' and 19-19' to move towards the chair shaped member 26.

While the above mentioned movement is taking place, the sections of the rods with a bracket configuration 18' and 19' cause the first considered pile P of cuttings S to be pushed, through a 25° rotation of the cyclic shaft 27, against the vertical wall of the chair shaped member 26, causing the cuttings S to be rearranged in the direction at right angles to that in which they were previously arranged.

Thereupon oscillation of the lever 54 initiated by the profile 33' of the cam 33 causes the block 22 to slide along the rods 16 and 17 and, consequently, the chair shaped member 26 to carry, due to a further rotation of 25°, the pile P of cuttings S under consideration into vertical alignment above the chute A. At this stage, through the profile 34' of the cam 34, the two armed lever 56 is made to oscillate and this, through its sector gear 61 meshing with the gear 62 causes the shaft 17 and, consequently, also the gear 23, to rotate. The rotation of gear 23 which meshes with the rack 25' of the vertical rod 25 causes the chair shaped member 26 on which the pile P is carried to descend, by a rotation of 65° on the part of the cyclic shaft 27, into the inside of the chute A for the pile P to be discharged therein and this breaks the beam of light from the detector devices 65-66. The profile 33' of the cam 33 is, at this point, designed in such a way as to cause a further displacement of the block 22, corresponding to approximately 60° of the complete cycle, in order to remove the chair shaped member 26 from underneath the pile P and to carry it beyond the chute A. The profile 34' of the cam 34 then causes the chair shaped member 26 to be carried upwards (75° approximately of the cycle), whereas the profile 33' of the cam 33 reverses the movement of the block 22 to carry the said chair shaped member 26 back to its original position.

At this juncture the shaft 27 has completed its cyclic revolution and thus the cam 63 opens the contact of the micro-switch 64, thereby de-energizing the contactor T1.

As the packeting machine continues to operate, the cuttings S are rhythmically removed from the bottom of the chute A thereby depleting the pile and once the level of the pile has dropped to a certain level, the beam of light from the detector device is no longer broken and thus a fresh cycle for infeeding the next pile of cuttings is initiated.

The results attained when using the apparatus forming the subject of the invention, as well as the practical and financial advantages resulting from its use are, in this way obvious.

For example, to remove from the bottom of the hopper the individual cuttings which are constantly kept therein at a variable level with limits that guarantee their being unfailingly removed by suction, obviously eliminates the frequent annoyances experienced with the infeed systems currently in use for these types of packeting machines.

Furthermore, with the possibility that exists of having a considerable availability of piles P of cuttings S on the accummulating conveyor D, with the piles being gradually fed into the inside of the chute A in an automatic fashion, the operator is able to devote his attention quietly and more usefully to the other operations that have to be done in the entire packaging plant. The way in which the large accumulation capacity conveyor D is positioned above the conveyor C of the packeting machine is also to the advantage of the operator insofar as the placing of the piles on the said accumulation conveyor is concerned. The last but by no means the least advantage of the apparatus forming the subject of the invention is that offered by the transverse spaced arrangement of the belts 10 of the accumulation conveyor D which makes it possible for the piles to be placed on the said conveyor by inserting the hand/s in between the said belts.

What is claimed is:

1. An apparatus for accumulating and supplying sheets, comprising;

a chute receptive of sheets to be dispensed therefrom and which normally lie transversely of the chute;

means for individually dispensing sheets from a base of the chute, including first conveyor means for removing them to a wrapping mechanism of a packeting machine in rhythmic succession;

an intermittently horizontally and vertically movable support device placeable in vertical alignment with the chute, above the same;

second conveyor means for conveying in an inching fashion, towards the support device, a plurality of piles of sheets, side by side;

centering and transfer means for handling whichever pile of sheets is, at any particular moment, closest to the support device to first move the pile in a first direction, lining it up with respect to the chute and then, in a direction at a right angle to the first, to transfer it to the support device;

power means for intermittently horizontally and vertically moving the support device and for intermittently operating the first and second conveyor means and the centering and transfer means; and feeler means sensitive to a lever of a pile of sheets in the chute, for actuating the power means to enable the individual piles to be transferred in succession from the second conveyor means to the support device and from the latter to the inside of the chute when said level has been reached in the container.

2. An apparatus according to claim 1 in which the intermittently movable support device comprises a horizontal bracket plate and a vertical rod, the lower extremity of the rod being integral with the bracket plate and the upper extremity of the rod comprising a rack; the means for operating the support device and conveyor means comprising a reciprocatingly a rotatable shaft and a pinion meshing with said rack and slidable on said shaft for reciprocating movement along the shaft to carry the bracket plate from an upper position thereof above the chute down towards the bottom of the container, from there horizontally beyond the chute and then vertically upwards and horizontally back to said upper position.

3. An apparatus according to claim 2, including cam means for causing the support device to slide horizontally in a reciprocating fashion for successively charging the chute with sheets and transferring the supporting device to a position for the inception of renewed charging.

4. An apparatus according to claim 1 in which the second conveyor means comprises a pair of continuous belts which extend parallel to and in vertical alignment above the first conveyor means.

5. An apparatus according to claim 1, in which the centering and transfer means comprise a plurality of vertical rods; connecting means restraining said rods at their respective, upper extremities; and means for horizontally parallel forward and backward movements of the connecting means in directions at a right angle to one another; said vertical rods having lower extremities to engage opposite horizontal ends of each pile of sheets supplied by the second conveyor means at points corresponding to two adjacent sides of each pile, one of which is the rear side of the pile with respect to each forward movement.

* * * * *